US005132589A

United States Patent [19]

Friedman

[11] Patent Number: 5,132,589

[45] Date of Patent: Jul. 21, 1992

[54] DUAL ACTION LIGHT BULB

[76] Inventor: Randall J. Friedman, 32 Old Nyack Turnpike, Monsey, N.Y. 10952

[21] Appl. No.: 750,524

[22] Filed: Aug. 27, 1991

[51] Int. Cl.[5] ..... H01J 17/00; H01J 63/02

[52] U.S. Cl. ..... 313/484; 313/514; 313/517; 313/619; 362/806

[58] Field of Search ..... 313/514, 517, 519, 619, 313/484; 362/806

[56] References Cited

U.S. PATENT DOCUMENTS 1,928,407 9/1933 Batchelor ..... 313/514
2,298,581 10/1942 Abadie ..... 313/8
2,520,513 8/1950 Sereno ..... 313/514

*Primary Examiner*—Donald J. Yusko
*Assistant Examiner*—N. D. Patel
*Attorney, Agent, or Firm*—Helfgott & Karas

[57] ABSTRACT

A special effect light bulb combines both cathode glow illumination with fluorescent illumination. A pair of plates respectively electrically connected to a pair of electrical lead wires jointly define a word, phrase or well-known symbol which is illuminated within an inert gas during operation of the light bulb. A third plate, having a fluorescent coating which is activated only by the ionized inert gas, is shaped in the form of a distinct symbol.

15 Claims, 1 Drawing Sheet

DUAL ACTION LIGHT BULB

BACKGROUND OF THE INVENTION

1. Field of the Invention

The present invention relates in general to a light bulb of the cathode glow type which is filled with an inert gas. In particular, the invention relates to such a light bulb which includes a pair of electrodes coated with an electron-emissive material and which includes an electrically inert element which is coated with a fluorescent material.

2. Description of Prior Developments

Luminescent light bulbs have been available in numerous forms for many years. Such bulbs may include a glass envelope within which an inert gas such as argon, neon and or helium is sealed under pressure. A pair of electrodes may be energized within the glass envelope with sufficiently high voltage to ionize the gas surrounding the negative electrode or cathode so that the gas emits a visible glow. With alternating current, each electrode acts alternately as a cathode so that each electrode appears to glow constantly.

As seen in U.S. Pat. No. 2,298,581, a lining of photoluminescent material may be provided on the inner surface of the glass envelope of a light bulb so that the radiation surrounding the electrodes activates the photoluminescent material thereby increasing the intensity of illumination. Instead of coating the inner walls of the glass envelope, Sereno, in U.S. Pat. No. 2,520,513 coats or stencils letters or symbols upon a glass plate which is mounted within a glass envelope. The letters or symbols are formed of a fluorescent material which is activated by ionized gases sealed within the glass envelope.

Many other variations of negative or cathode glow light bulbs have been developed over the years for many varied applications. However, a need continually exists for such bulbs which produce new and different lighting effects. This is particularly the case in the field of special effect lighting such as used in advertising and novelty applications.

SUMMARY OF THE INVENTION

The present invention has been developed to produce a new special effect light bulb which combines both negative or cathode-type glow lighting with fluorescent lighting in a manner which is particularly distinctive. Briefly, an electrically inert or electrically unconnected plate is coated with a lamp phosphor and mounted within a cathode-type glow lamp. Each of the electrodes of the glow lamp is formed as a portion of a word or words, letter, figure or recognizable character so that when electrically activated, the electrodes glow in the same identifiable form. The ionized gas surrounding the electrodes activates the lamp phosphors on the inert plate causing the plate to react and reflect light with a distinctive effect.

The inert plate is preferably configured as a known word, symbol, character or figure which relates to, completes or embellishes the words, figures, etc. defined by the electrodes.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the Drawings

In the various figures of the drawing, like reference characters designate like parts.

DETAILED DESCRIPTION OF THE PREFERRED EMBODIMENTS

Figure 1:
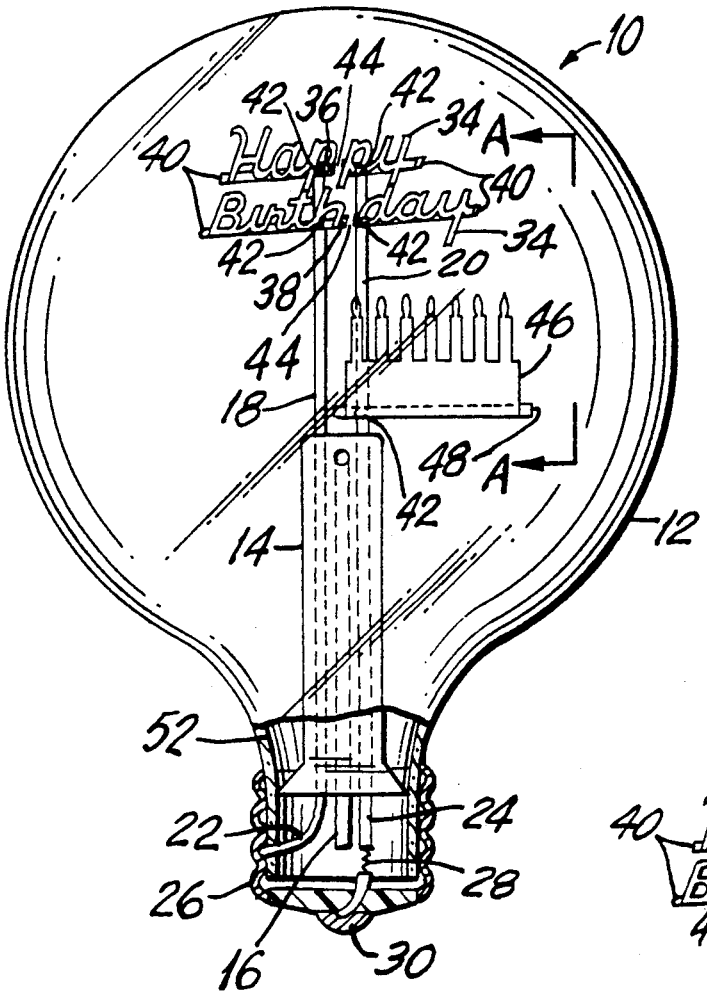
FIG. 1 is a front elevation view of a light bulb constructed in accordance with the present invention.

The present invention will now be described in conjunction with FIG. 1 which shows a light bulb 10 of the negative glow type, also known as a cathode glow type bulb. Bulb 10 includes a conventional glass envelope 12 preferably formed of a soft lime glass, although a harder boro-silicate glass could be used. A conventional lime glass stem 14 is mounted within envelope 12 in a known fashion. Stem 14 includes a standard exhaust tube 16 used in the exhaustion of ambient atmosphere and other gases from envelope 12.

First and second lead wires 18,20 are mounted in the stem. The lead wires 18,20 are generally larger in diameter than conventional lead wires in order to provide the necessary column support as described below. For example, lead wires 18,20 maybe constructed from 0.040 inch diameter nickel plated wire available commercially under the name Dumet. These wires are preferably coated with zirconium oxide to prevent their illumination during use.

The bottom end portion 22,24 of each lead wire 18,20 is attached to a standard base 26 with brass and glass frit. Base 26 is typically constructed from a thin sheet of brass or steel and bonded to the glass envelope 12 with a standard basing cement such as calcium carbonate. A resistor 28 may be electrically connected between one of the base contacts 30 and one of the lead wires 20 in a known manner.

A matched pair of graphic plates 32,34 is spot welded to the free end portions of lead wires 18,20. Each plate is formed as a portion of a letter or letters, a portion of a word, words or phrase, or as a portion of any graphic figure or symbol that represents information such as a name, trade name or trademark. Plates 32 and 34 may be stamped or photoetched from a single piece of stock sheet metal as a one-piece stamping or etching and then severed into two matching portions along parting lines 36,38.

It is preferable to form plates 32,34 from carbon-free metals such as pure nickel, magnesium or Swedish steel known as SVEA steel. The absence of carbon prevents blackening of the inner surface of glass envelope 12 during operation of the light bulb. A preferred thickness for a pure nickel or nickel alloy stamping or etching is about 0.010 inch.

Each graphic plate is scored or pitted such as by dipping in weak hydrochloric acid. An adhesive of, for example, nitro-cellulose combined with a small amount of amil acetate is then applied over each plate for binding a coating of a material or composition which promotes the emission of electrons under an induced electrical potential. Such a coating may take the form of a mixture of barium azide and cesium azide or a mixture of barium carbonate and a small amount of zirconiumoxide.

A preferred form of each graphic plate 32,34 is achieved by stamping or etching a virtually carbon-free nickel alloy sheet in the shape of the entire graphic phrase or symbol to be displayed as desired, and then welding a thin metal bus wire 40 along the entire length of the plate such as along its lower edge. Wire 40 may be of the same type of wire used to fabricate lead wires 18,20. The use of wire 40 is important for ensuring that each area or letter of each graphic plate receives adequate voltage for generating a negative glow discharge.

The unitary graphic plate and wire 40 are then severed at an appropriate spot or spots to form the matched pair of graphic plates 32,34. As seen in FIG. 2, each plate 32,34 is then welded to one of the lead wires 18,20 on stem 14 through bus wire 40. Such welding may take the form of spot welds 42 shown in FIGS. 1 and 3.

A gap 44 of at least about 0.015 inch is maintained between each pair of confronting severed surfaces of each plate. Such spacing ensures an efficient negative discharge of electrons and an accompanying negative glow during operation of the light bulb. A small spaced overlap of several thousandths of an inch should be maintained between the graphic plates across gap 44.

The graphic plates, attached to the free stem 14 as seen in FIG. 2, are dipped in a weak solution of HCl to remove all oils and surface impurities from the plates. This also aids in the adhesion of a barium coating to be applied at a later point. The plates 32,34 are now cleaned with distilled water and dried.

Next, a mixture of barium carbonate and a small amount of zirconium oxide are combined with nitro-cellulose and a small amount of amil acetate to form a semi-paste or semi-liquid. The zirconiumoxide prevents the evaporation of the barium during a subsequent induction heating operation. This mixture is then brushed onto the graphic plates or the graphic plates may be dipped or immersed into the mixture until each plate is completely coated. At this point the coated plates are oven-heated to cure the coating and then set aside.

Figure 2:
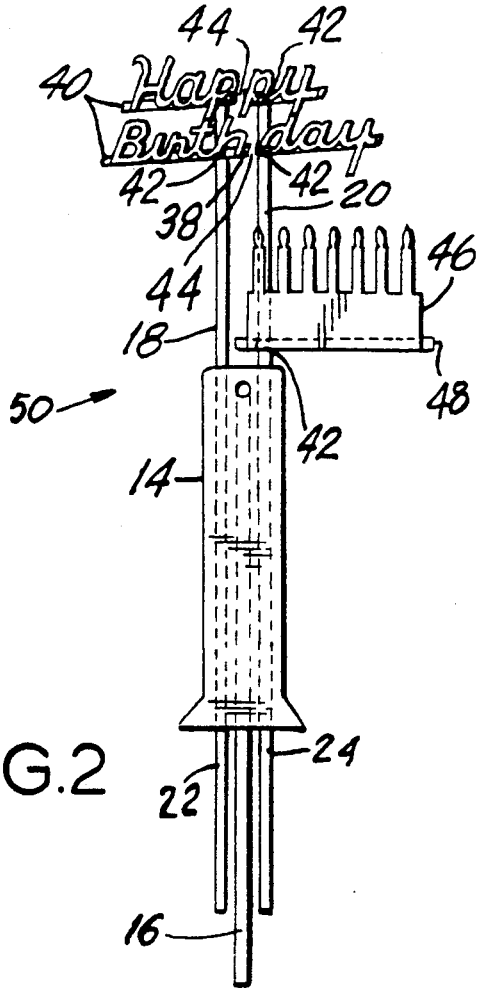
FIG. 2 is a front elevation view of a sub-assembly used to fabricate the light bulb of FIG. 1.

As further seen in FIG. 1, light bulb 10 includes another stamped or etched metal plate 46 which may be fabricated from the same materials as used to fabricate the graphic plates 32,34, e.g., nickel alloy. Plate 46, referred to as a design plate, is provided for decoration as well as to produce a special luminescent lighting effect as well as to increase the illumination of light bulb 10. Design plate 46 is generally formed as a one-piece plate in the shape of a distinct, easily recognized symbol or figure and is subsequently coated with a lamp phosphor or similar fluorescent material.

A support wire 48 which may be made from the same wire as bus wire 40 is spot-welded to the design plate 46 for the sole purpose of securely supporting the design plate on one of the lead wires 18,20. Prior to mounting design plate 46 on one of the lead wires, plate 46 is scored such as by immersion in an acid bath to facilitate and improve the bonding of the lamp phosphors and/or fluorescent coatings to the surface of plate 46. Plate 46 is then coated with a solution of lamp phosphor and nitro-cellulose along with a small amount of amil acetate which serves as a binder.

Examples of lamp phosphors which may be used to coat design plate 46 include calcium lead tungstate, zinc orthosilicate manganese and magnesium silicate. The following listed fluorescent phosphor coatings, when activated in an atmosphere of the listed inert gases, will produce the listed colors when used in accordance with the invention:

| | |
|---|---|
| $Zn_2Si_4$:Mn + Neon | Orange-gold |
| $Zn_2Si_4$:Mn + Argon | Green |
| $CaWO_4$:Pb + $Zn_2SiO_4$:Mn + Neon | Pink-peach |
| $CaWO_4$:Pb + $Zn_2SiO_4$:Mn + Argon | Turquoise |
| $CaWO_4$:Pb + Neon | Rose pink |
| $CaWO_4$:Pb + Argon | Deep blue |
| $CaSiO_3$:Pb:Mn + Neon | Pink |
| $CaSiO_3$:Pb:Mn + Argon | White |
| $Ba_2P_2O_7$:Ti + Neon | Red |
| $Ba_2P_2O_7$:Ti + Argon | Pink |

Figure 3:
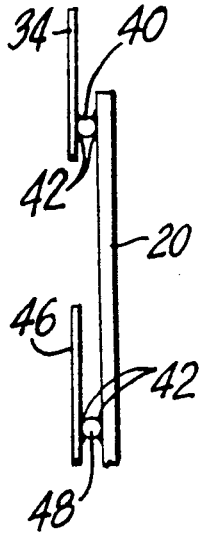
FIG. 3 is a fragmental side view taken along line A—A of FIG. 1.

After such coating by brushing or dipping in a phosphor or fluorescent material, design plate 46 may be oven-dried, for example at 300° F. for five minutes, to remove all water and impurities from the coating. After drying, the design plate may then be tack or spot-welded to only one of the lead wires 18,20 through support wire 48. The resulting weld 42 is shown in FIG. 3.

Zirconium oxide may then be brushed over the exposed surfaces of lead wires 18,20 to prevent their illumination during operation of light bulb 10. This last coating of zirconium oxide should be heated as described above to remove all water contents. The resulting subassembly 50, as shown in FIG. 2, is ready to be inserted within glass envelope 12 of bulb 10.

In the next step of manufacture, the lead wires 18,20 of subassembly 50 are squeezed together so that the graphic plates 32,34 overlap one another and the design plate 46 is bent, turned or deflected in order to allow the subassembly 50 along with glass stem 14 to pass through the neck 52 of glass envelope 12. Once inserted, the graphic plates and the design plate are repositioned to their original positions as shown in FIG. 1 using an elongated reverse action tweezer tool.

At this point, the glass envelope 12 and subassembly 50 are sealed together as a unit as described above. The interior of glass envelope 12 is then exhausted of gases such as $H_2O$, $O_2$ and $CO_2$ through exhaust tube 16. The glass envelope is then flushed with nitrogen and then exhausted again. During final exhaustion, the graphic plates 32,34 within light bulb 10 are subjected to an induction heating process wherein three to six induction heating coils surround the glass envelope adjacent the graphic plates.

The graphic plates are induction heated to a temperature of about 1100° C. to 1200° C. for a period of about 8 to 12 seconds. The barium carbonate coating on the graphic plates is converted to barium oxide which improves the emission of electrons from the graphic plates during operation of the light bulb 10. This enhanced emission of electrons increases the ionization of gas within the glass envelope and thus increases the intensity of illumination. Induction heating temperature in excess of 1200° C. should be avoided as barium will evaporate and be exhausted through tube 16 at such high temperature.

Once exhaustion is completed, the glass envelope 12 is overfilled with an inert a gas at a pressure between about 5 to 20 torr. This gas is then slowly withdrawn while standard alternating current is applied to lead wires 18,20. When a satisfactory cathode glow develops between and over and around the graphic plates 32,34, the exhaust tube causes the exhaust tube to collapse and to thereby seal in all gases at a desired pressure.

The inert gas is selected to produce a desired color of light around the graphic plates. The following listed gases will produce the corresponding listed colors when used with the barium coated graphic plates of FIG. 1:

| | |
|---|---|
| Argon | Violet |
| Neon | Orange red |
| Krypton | Greenish |
| Helium | Yellowish gold |
| Neon + Trace of Rubidium Vapor | Red |
| Neon + Mercury Vapor + Caesium Vapor | Yellow |
| Argon + Trace of Mercury Vapor + Trace of Rubidium Vapor | Blue |
| Krypton(5%) + Neon(95%) | Yellow |
| Argon + Trace of Mercury Vapor | White |

Adding helium to any of the above gases causes an increase in the voltage drop between the graphic plates and increases the brightness or illumination of the light bulb. The higher the gas pressure within the glass envelope, the more intense is the luminous cathodic glow, although the current required to operate the bulb increases with increasing gas pressure. If the gas pressure is too high, no illumination or glow will be produced. Conversely, if the gas pressure is too low, the graphic plates will experience sputtering.

Once the exhaust tube 16 is sealed, resistor 28 may be soldered to lead wire 20 and to contact 30 of base 26. The other lead wire 18 may be soldered to the inner side surface of the base 26. The base is then soldered with brazing frit and glued to the neck 52 of glass envelope 12 with calcium carbonate.

In operation, the light bulb 10 may be designed to operate at 60 volts and with a current of 5 milliamps. In this case, resistor 28 should be approximately 12 to 15 ohms. Bulb 10 could be designed to operate at 2.4 volts with 20 milliamps of current. In this case, resistor 28 should be about 6000 ohms. Standard insertable carbon resistor rings could be used in place of resistors 28, if desired.

When light bulb 10 is screwed into a standard light socket and voltage is applied between lead wires 18,20 and graphic plates 32,34, a cathodic glow of ionized gas is produced around the graphic plates as electrons flow alternately back and forth between the plates across gaps 44. The ionized gases react with the fluorescent or phosphor coating on design plate 46 and cause design plate 46 to glow as well as to reflect the light from the cathode glow.

This combined lighting effect of the cathode glow and fluorescent glow is particularly distinctive and eye-catching and is particularly well suited for advertising applications insofar as both the graphic plates and the design plate convey information in written and/or symbolic form while illuminating their surrounding area. The graphic plates 32,34 glow brighter than the design plate as the design plate simply reflects the light from the graphic plates. No thermionic illumination takes place within glass envelope 12.

It should be noted that design plate 46 is electrically disconnected from any applied voltage across lead wires 18,20. That is, design plate 46 is activated only by the ionized gas within glass envelope 12 and not by any directly applied voltage. Design plate 46 merely uses one of the lead wires as a support. In fact, a separate support wire for design plate 46 could be provided in glass stem 14, although this would not be economical.

Obviously, numerous modifications and variations of the present invention are possible in the light of the above teachings. It is therefore to be understood that within the scope of the appended claims, the invention may be practiced otherwise than as specifically described herein.

What is claimed is:

1. A light bulb, comprising:

a glass envelope;

a glass stem mounted within said envelope;

a first electrical lead wire and a second electrical lead wire each passing through said stem;

a first graphic plate supported on said first electrical lead wire and a second graphic plate supported on said second electrical lead wire, said first graphic plate being spaced from said second graphic plate so as to define a gap therebetween, said first and second graphic plates being electrically conductive and being electrically connected to said first and second electrical lead wires, respectively;

a coating of an electron emitting material provided on said first and second graphic plates;

a design plate disposed within said envelope and supported by said stem;

a coating of a fluorescent material provided on said design plate; and an inert gas sealed within said envelope and surrounding said first and second graphic plates and said design plate.

2. The light bulb of claim 1, wherein said coating of an electron emitting material comprises barium.

3. The light bulb of claim 1, wherein said coating of fluorescent material comprises a lamp phosphor.

4. The light bulb of claim 1, wherein said gap is about 0.015 inch.

5. The light bulb of claim 1, wherein each of said first and second graphic plates is formed in the shape of at least one letter.

6. The light bulb of claim 5, wherein said first and second graphic plates jointly form a written word.

7. The light bulb of claim 6, wherein said design plate is shaped as a distinct symbol.

8. The light bulb of claim 1, wherein each of said first and second graphic plates and said design plate are formed from sheet metal.

9. The light bulb of claim 8, wherein said sheet metal comprises nickel.

10. The light bulb of claim 8, wherein said sheet metal has a thickness of about 0.10 inch.

11. The light bulb of claim 1, wherein said coating of electron emitting material has been induction-heated.

12. The light bulb of claim 1, wherein said design plate is mounted to only one of said lead wires.

13. The light bulb of claim 1, wherein said first and second graphic plates and said design plate are tack-welded to said electrical lead wires.

14. The light bulb of claim 1, further comprising a first bus wire connected to said first graphic plate and a second bus wire connected to said second graphic plate and wherein said first and second graphic plates are connected to said first and second electrical lead wires by welds formed through said first and second bus wires.

15. The light bulb of claim 14, further comprising a support wire connected to said design plate and wherein said design plate is welded to only one of said electrical lead wires through said support wire.

* * * * *